United States Patent [19]

Uedaira et al.

[11] 4,311,539

[45] Jan. 19, 1982

[54] METHOD OF MANUFACTURING A HIGH PERMEABILITY AMORPHOUS MAGNETIC ALLOY

[75] Inventors: Satoru Uedaira; Shigeyasu Ito; Koichi Aso; Masatoshi Hayakawa, all of Tokyo, Japan

[73] Assignee: Sony Corporation, Tokyo, Japan

[21] Appl. No.: 153,869

[22] Filed: May 28, 1980

[30] Foreign Application Priority Data

Jun. 4, 1979 [JP] Japan ..... 54-69558

[51] Int. Cl.[3] ..... H01F 1/00

[52] U.S. Cl. ..... 148/121; 148/3; 148/101

[58] Field of Search ..... 148/100, 101, 108, 120, 148/121, 122, 31.55, 103, 3

[56] References Cited

U.S. PATENT DOCUMENTS 4,056,411 11/1977 Chen et al. ..... 148/121

4,187,128 2/1980 Billings et al. ..... 148/101

*Primary Examiner*—L. Dewayne Rutledge

*Assistant Examiner*—John P. Sheehan

*Attorney, Agent, or Firm*—Hill, Van Santen, Steadman, Chiara & Simpson

[57] ABSTRACT

A method of manufacturing an high permeability amorphous magnetic alloy is disclosed. In the method, an amorphous alloy ribbon is annealed at an elevated temperature T(°K.) satisfying the relation $0.95 \times Tc$ (°K.)$\leqq$T(°K.)$<$Tcry(°K.) where Tc is a magnetic Curie temperature and Tcry is a crystallization temperature of the alloy. Then the ribbon is quenched to a room temperature from the elevated temperature. The quenched amorphous alloy ribbon is again annealed at a temperature between 100° C. and 250° C. By the method, the amorphous magnetic alloy shows a high permeability over a wide frequency range and flat frequency response characteristics of permeability over a wide frequency range.

7 Claims, 7 Drawing Figures

$Fe_{4.7}Co_{70.3}Si_{15}B_{10}$
4A
4B
$10^5$
$10^4$
$10^3$
$10^2$
Permeability
1 KHz
10KHz
100KHz
1 MHz
10MHz
Frequency $Fe_{4.7}Co_{70.3}Si_{15}B_{10}$
5A
5B
5C
5D
5E
5F
5G
$10^4$
$10^3$
$10^2$
Permeability
1 KHz
10 KHz
100 KHz
1 MHz
10 MHz
Frequency

METHOD OF MANUFACTURING A HIGH PERMEABILITY AMORPHOUS MAGNETIC ALLOY

BACKGROUND OF THE INVENTION

1. Field of the Invention

This inveniton relates generally to a method of manufacturing an amorphous magnetic alloy, and especially to heat treatment of an amorphous magnetic alloy having high permeability.

2. Description of the Prior Art

In the art, there are known a centrifugal quenching method, single roll quenching method, double rolls quenching method and so on to prepare amorphous magnetic alloys which are known as soft magnetic material. In these methods, a melt of raw material containing metal elements and so-called forming elements is quenched to form amorphous alloy ribbons. In the method, internal stress $\theta$ is induced in the amorphous ribbon during manufacturing, which results in deteriorated magnetic characteristics by coupling with a magnetostriction constant $\lambda$. Since the permeability $\mu$ satisfies the relation $\mu \propto (1/\lambda\sigma)$, larger internal stress results in a deteriorated permeability $\mu$ and an increased coercive force Hc, and both are not desirable characteristics for soft magnetic material used as core elements of a magnetic circuit. Among various amorphous magnetic alloys, it is known that iron system amorphous alloys can be improved in permeability by annealing at the elevated temperature under an application of a magnetic field or without the application of a magnetic field to release the internal stress. However, it was found that iron-cobalt system amorphous alloys, and iron-nickel system alloys could not be improved in permeability by annealing at an elevated temperature under the application of the magnetic field or without the application of the field. Further, during processing such amorphous alloy ribbons, for example during cutting or chemical etching the ribbon to form a shaped core, stress is further induced, which results in further deteriorated magnetic characteristics, especially in permeability. In making a magnetic transducer head using these amorphous magnetic alloys as core material, a high premeability is required over an extended operating frequency range, for example 1 to 10 MH in case of a magnetic head handling a video signal. In the prior art method, the annealing is not satisfactory as mentioned above and a countermove to avoid the deterioration in permeability after the annealing is not presently available.

Considering the above, the invention of the present application proposes a method to improve magnetic characteristics of a Co-Fe system amorphous magnetic alloy, in which the amorphous alloy has a magnetic Curie temperature (Tc) lower than its crystallization temperature (Tcry). In the method an amorphous alloy ribbon can be prepared in which the ribbon has a composition of, for example, $(Fe_{1-x}Co_x)_{100-z}(Si_{1-y}B_y)_z$ where $0.90 \leqq x \leqq 0.98$, $0.30 \leqq y \leqq 0.80$ and $22 \leqq z \leqq 30$. Then the ribbon is cut into a suitable core shape. The shaped core is kept at an elevated temperature T, satisfying the relation. $0.95 \times Tc(°K.) \leqq T_1(°K) \leqq Tcry(°K)$ and then quenched. The method can improve magnetic characteristics, for example, permeability of the alloy over a wide frequency range. However, by this method, the frequency response characteristics is not flat which restricts the usage of the alloy, and further aging characteristics of permeability are not stable, which means that permeability becomes deteriorated during use.

OBJECT AND SUMMARY OF THE INVENTION

Accordingly, it is an object of the present invention to provide an improved method of manufacturing a high permeability amorphous magnetic alloy.

It is another object of the present invention to provide a method of manufacturing an amorphous magnetic alloy having high permeability for use over a wide frequency range.

It is a further object of the present invention to provide a method of manufacturing an amorphous magnetic alloy having a flat frequency response characteristic of permeability over a wide frequency range.

It is still further object of the present invention to provide a method of manufacturing an amorphous magnetic alloy having high permeability and having stable aging characteristics of permeability.

According to one aspect of the present invention there is provided a method of manufacturing a high permeability amorphous magnetic alloy which comprises the steps of:

(a) preparing an amorphous magnetic alloy having a Curie temperature Tc(°K.) which is lower than its crystallization temperature Tcry(°K.), (b) keeping said alloy at a first temperature $T_1$(°K.) satisfying the relation $0.95 \times Tc(°K.) \leqq T_1(°K.) < Tcry(°K.)$, (c) quenching said alloy from said first temperature $T_1$(°K.), and (d) annealing said alloy at a second temperature $T_2$ between 100° and 250° C.

The other objects, features and advantages of the present invention will become apparent from the following description taken in conjunction with the accompanying drawings.

DESCRIPTION OF THE PREFERRED EMBODIMENTS

Figure 1:
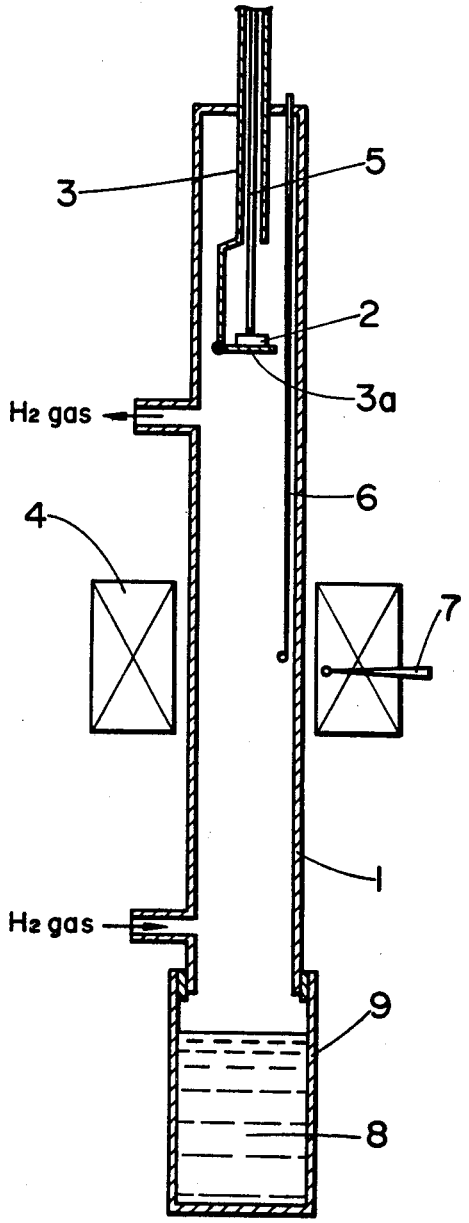
FIG. 1 is a cross sectional view of a furnace used to carry out the method of the present invention.

The present invention will be hereinafter described in detail. In this invention, a cobalt-iron system amorphous magnetic alloy ribbon is first prepared. The ribbon can be manufactured by quenching a melt containing metal elements and so called glass-forming elements by known methods, for example, the centrifugal quenching, single roll quenching, or double rolls quenching method. The cobalt-iron system alloy which contains cobalt and iron as the main compornents with the glass forming elements, has a magnetic Curie temperature Tc lower than its crystallization temperature Tcry. The alloy ribbon is then subjected to the heat treatment of the present invention. The amorphous alloy ribbon prepared is kept at an elevated temperature $T_1$(°K.)

satisfying the relation $0.95 \times Tc(°K.) \leqq T_1(°K.) < Tcry(°K)$ and then quenched (this will be hereinafter referred to as the first heat treatment). Then the quenched ribbon is annealed at a temperature $T_2$ between 100° and 250° C. without applying an external magnetic field (this will be hereinafter referred to as second heat treatment). By the first heat treatment, stress induced in the amorphous alloy during the processing, such as cutting into a suitable core shape, or chemically etching to reduce the thickness of the ribbon, is removed effectively which results in an improved permeability of the amorphous alloy core. Further, induced magnetic anisotropy due to the existence of cobalt is also removed by the first heat treatment. Accordingly a sufficiently high permeability for use as core material of the magnetic transducer head can be given to the alloy. In this connection it is more preferably that the temperature $T_1$ of the annealing in the first heat treatment be selected to satisfy the relation $0.97 \times Tc(°K.) \leqq T_1(°K.) \leqq 0.98 \times Tcry(°K.)$. The quenching is preferably carried out at a cooling rate greater than 100° C./sec, and more preferably at a cooling rate greater than 500° C./sec. The quenching can be carried out by immersing the amorphous alloy core into a liquid coolant, such as water, silicone oil, or cooking oil.

It is very important in the present invention that the second heat treatment be applied to the amorphous alloy core subsequent to the first heat treatment. By the second heat treatment, permeability at the low frequency range is somewhat lowered (however the permeability is still high enough from a practical point of view) while maintaining the permeability at high frequency as quenched, which results in a flat frequency response up to several hundred kHz. Further by the second heat treatment, instability of aging characteristics of permeability can be avoided. When the temperature of the second heat treatment is lower than 100° C., the permeability at the low frequency end is not lowered enough and a flat frequency response cannot be obtained, while when the temperature is higher than 250° C., the permeability is lowered too much over all the frequency range. The second heat treatment must be carried out without applying an external magnetic field. If it is carried out under the magnetic field, the permeability is deteriorated by induced magnetic anisotropy due to the existence of cobalt.

A suitable amorphous alloy composition subjected to the method of the present invention will be described. The alloy contains not less than 60 atomic% of cobalt, not more than 20 atomic% of iron for a total of 100 atomic% of the alloy. When iron is more than 20 atomic%, the magnetostriction constant becomes a large positive value. Iron must be present since iron works to cancel the negative magnetostriction constant of cobalt and also increases the saturation magnetic induction. A part of the cobalt, may be replaced with other elements, such as nickel. The replacing amount should not be more than 15 atomic% for the total 100 atomic% of the alloy. The replacement with nickel lowers the magnetic Curie temperature of the alloy which is preferable to achieve the first heat treatment, however it reduces the saturation magnetic induction. The glass forming elements are preferably Si and/or B, however P, C, and Ge can be used. The glass forming elements must be present in an amount not less than 22 atomic% for total 100 atomic% of the alloy. When the amount is less than 22 atomic%, even though the amorphous alloy is manufactured, the heat treatment is very difficult.

More preferable composition of the amorphous alloy is expressed at $(Fe_{1-x}Co_x)_{100-z}(Si_{1-y}B_y)_z$ where $0.90 \leqq x \leqq 0.98$, $0.30 \leqq y \leqq 0.80$, $22 \leqq z > 30$. In this case part of cobalt may be replaced by nickel, and a part of Si and/or B may be replaced by P, C, or Ge. When x exceeds 0.98 the alloy has a large negative magnetostriction constant, while when x is less than 0.90 the alloy has a large positive magnetostriction constant; both are not desirable. By selecting the value x as above, an alloy having nearly zero magnetostriction constant can be obtained. When y is selected in the above range, most suitable characteristics in the amorphous alloy can be obtained. When z is less than 22, it is difficult to form the amorphous alloy and to carry out the heat treatment, while when z exceeds 30 saturation magnetic induction is decreased.

Next, the method according to the present invention will be further described in detail with reference to FIGS. 1 to 7.

FIG. 1 shows an example of a furnace to keep the amorphous alloy at an elevated temperature and to quench. There is provided a sample holder 3 made of stainless steel having a sample holder plate 3*a* rotatably connected at one end of the holder to hold a shaped core of the amorphous alloy sample 2 and to drop the sample 2 as required. The sample holder 3 is received through an upper wall of a quartz tube 1 and is movable up and down. The sample 2 is in contact with a lower end of a thermo couple 5 extending in the sample holder 3 to measure the temperature of the sample. A heater 4 is provided along the furnace to keep the inside of the furnace at a predetermined temperature. The temperature is controlled by temperature measuring thermocouples 6 and 7, one being provided in the tube, another being provided in the heater as shown in FIG. 1. At the lower end of the tube 1, a container 9 made of quartz is removably provided and contains liquid coolant 8.

The operating method of the furnace will be explained below. The alloy sample to be treated is placed on the sample holder plate 3*a*, and the sample holder is held at the upper portion of the furnace as shown in FIG. 1. Hydrogen gas to avoid oxidation of the sample is introduced into the tube 1 and replaces the inside atmosphere with it. The inside of the furnace is heated to a predetermined temperature by the heater 4, and the holder 3 is moved downwardly to an area of predetermined temperature in the furnace to heat the sample 2, at the predetermined temperature in a short time and the sample is kept at the temperature for a while. As previously explained, the temperature is higher than the Curie temperature and lower than the crystallization temperature of the sample alloy. Then the sample 2 is dropped into the liquid coolant 8 by rotating the sample holding plate 3*a* downwardly and is quenched. Then the sample is picked up from the liquid and heated again at a temperature between 100° and 250° C. without applying an external magnetic field. This heat treatment can be carried out by using the furnace shown in FIG. 1 or any furnace.

Figure 2:
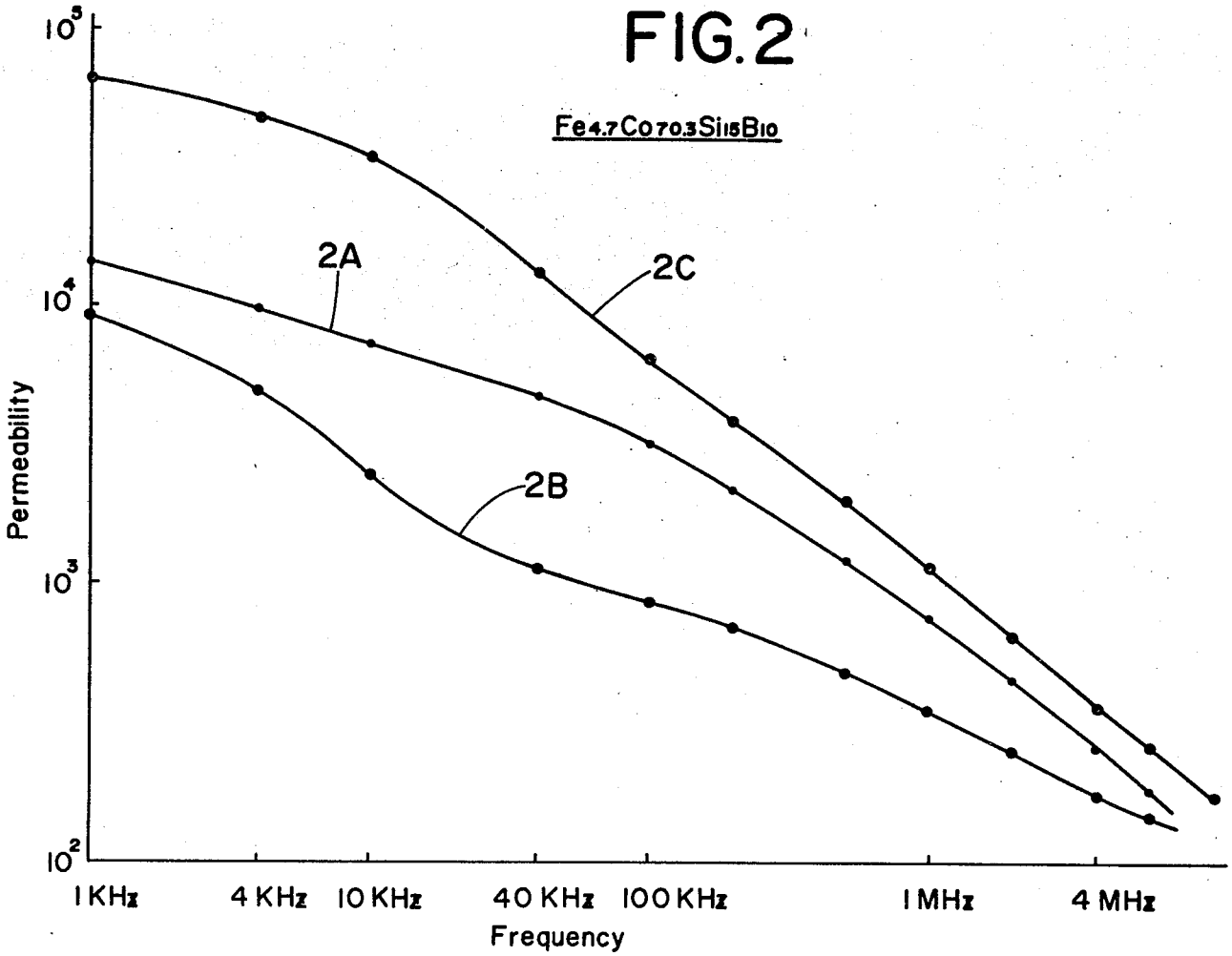
FIG. 2 and 4 are graphs showing permeability versus frequency characteristics of amorphous alloy samples subjected to various heat treatments.

FIG. 2 shows the frequency versus permeability characteristics of amorphous alloy samples subjected to various treatments. The sample was cut out to form a shaped core from 9 superposed amorphous alloy ribbons having a composition of $Fe_{4.7}Co_{70.3}Si_{15}B_{10}$ and having a total thickness of 336μ. In FIG. 2, line 2A shows the characteristics of the sample as prepared, line 2B shows a characteristics of the sample annealed at 210° C. for 20 minutes under the application of the magnetic field of 10 Oe, and line 2C shows the characteristics of the sample annealed at 430° C. which satisfies the relation $0.95 \times Tc \leqq T < Tcry$ and then quenched to room temperature. The Curie temperature of the sample alloy was 659° K. (386° C.) and its crystallization temperature was 783° K.(510° C.). That is, the line 2C shows the characteristic of the sample subjected to the first heat treatment. Each value of permeability was measured under a magnetic field of 10mOe, at 2 minutes after demagnetization. According to FIG. 2, it is understood that the permeability of the sample annealed under the application of the magnetic field was deteriorated from the sample as prepared. It is considered that this deterioration of permeability is due to induced magnetic anisotropy caused by cobalt ions in the amorphous alloy. While, it is noted that permeability of the sample annealed at 430° C., which is higher than Curie temperature (380° C.) and lower than crystallization temperature (510° C.) is remarkably increased and exceeds the over all frequency range as compared with the sample as prepared. It is desirable for a core material for a magnetic transducer head handling a video signal since line 2C shows high permeability at the high frequency range (1–10MHz), considering together that the amorphous alloy has a high saturation magnetic induction (for example 8200 gauss) which is by far larger than that of a magnetic ferrite (for example 5000 gauss). However, since the frequency response characteristics of permeability are not flat over a wide frequency range, there is still a necessity to improve the method.

Figure 3:
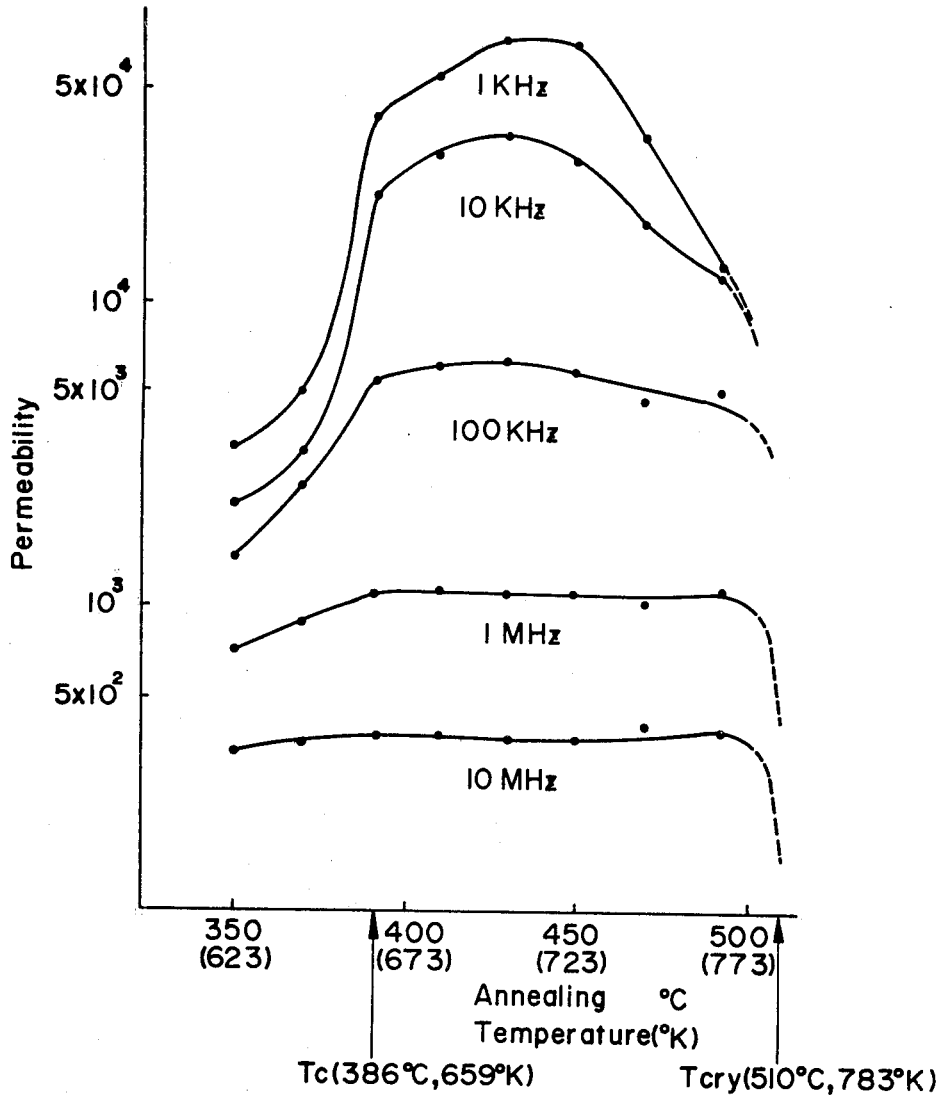
FIG. 3 is a graph showing the relation between permeability and the temperature of the first heat treatment.

FIG. 3 shows relations between permeability and a temperature during the first heat treatment at various frequencies. The data were obtained from the samples subjected to the first heat treatment. Permeability was measured at frequencies of 1kHz, 10kHz, 100kHz, 1MHz, and 10MHz. It is noted that the annealing temperature $T_1$ in the first heat treatment must satisfy the following relation to improve the permeability of the alloy: $0.95 \times Tc(°K.) \leqq T < Tcry(°K.)$ where Tc is the Curie temperature of the alloy and Tcry is its crystallization temperature. The present alloy sample has a Curie temperature of 659° K. (386° C.) and a crystallization temperature of 783° K.(510° C.). It is further noted from FIG. 3 that the annealing temperature more preferably satisfies the relation $0.97 \times Tc(°K.) \leqq T(°K.) \leqq 0.98 \times Tcry(°K.)$ to obtain higher permeability.

Figure 4:
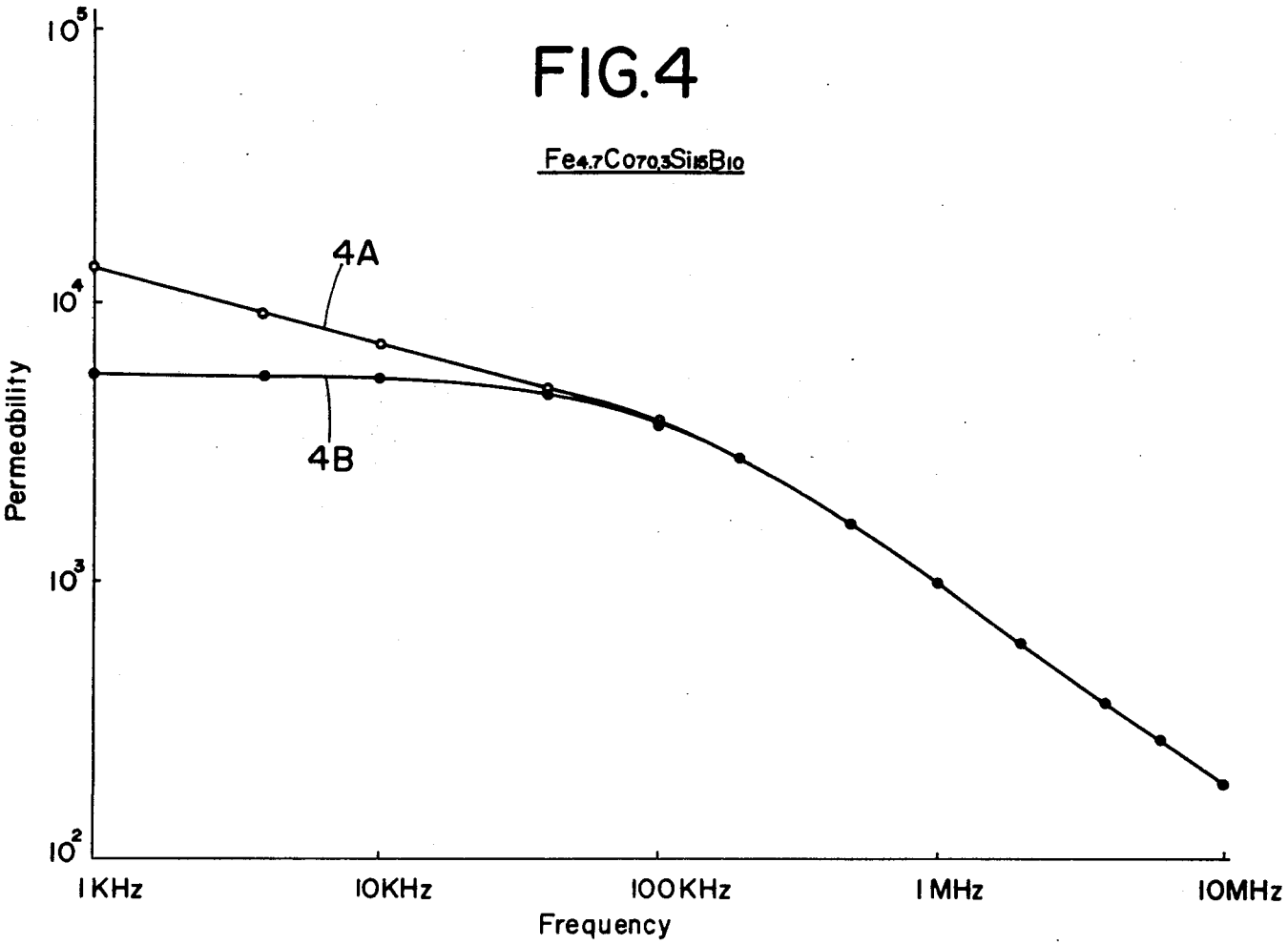

FIG. 4 shows frequency versus permeability characteristics of the amorphour alloy. In this case the samples were prepared by cutting out into core shape from 10 superposed amorphous alloy ribbons having a composition of $Fe_{4.7}Co_{70.3}Si_{15}B_{10}$ and having a total thickness of 315μ. In FIG. 4, line 4A shows the characteristics of the sample as prepared, and line 4B shows the characteristics of the sample annealed at 220° C. for 20 minutes without applying an external magnetic field after cutting. In this case permeability at low frequencies was lowered as compared with a sample as prepared which resulted in flat frequency response characteristics, though the permeability was generally low over all the frequency range.

Figure 5:
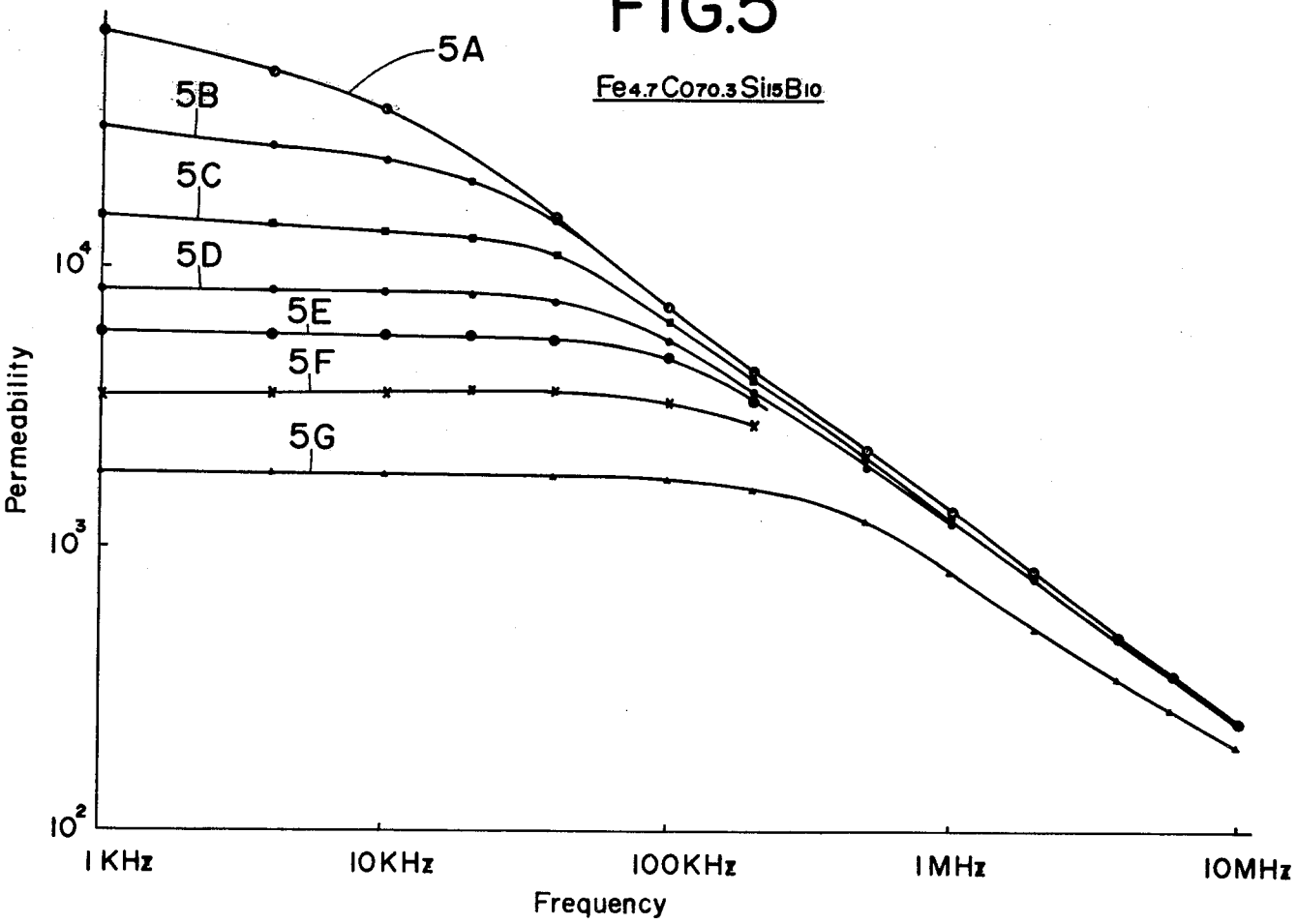
FIGS. 5 to 7 are graphs showing permeability versus frequency characteristics of amorphous magnetic alloy samples subjected to various heat treatments including the ones of the present invention.

FIG. 5 shows frequency versus permeability characteristics of the amorphous alloy samples subjected to various treatments. The samples were prepared similar by to the samples used in FIG. 4. The samples had a total thickness of 315μ and were cut from 10 sheets of amorphous alloy ribbons having a composition of $Fe_{4.7}Co_{70.3}Si_{15}B_{10}$. In FIG. 5, line 5A shows the characteristics of the sample kept at 430° C. for 3 minutes and then quenched. Lines 5B to 5G show the characteristics of the samples subjected to the heat treatment of the present invention. That is, the samples kept at 430° C. for 3 minutes and then quenched were further subjected to the second heat treatment at elevated temperature without applying an external magnetic field. The lines 5B to 5G show the characteristics of the samples subjected to the second heat treatment at 150° C., 180° C., 200° C., 220° C., 240° C. and 300° C. for 20 minutes respectively. It is noted that there is a tendency that as the temperature of the second heat treatment increases, permeability at low frequency decreases while maintaining permeability high at high frequencies and the range of frequency where permeability is flat becomes wider. As apparent from the result, according to the present invention, flat frequency response characteristics of permeability can be obtained by the second heat treatment after the quenching, while without the further heat treatment, high permeability can be obtained, though flatness is not good. By comparing FIGS. 4 and 5, it is understood that according to the method of the present invention it is possible to obtain an amorphous alloy having high permeability over a wide frequency range and having superior flatness of permeability over a wide frequency range. As noted from FIG. 5, when the temperature of the second heat treatment is low, flatness of permeability for a wide frequency range cannot be obtained, while when the temperature becomes high, flat frequency response can be obtained, however permeability decreases substantially lower than a practical permeability value over all the frequency range. Considering the flatness of permeability for wide frequency range and high permeability, it is desirable to select the temperature of the second heat treatment between 100° and 250° C. and more preferably between 180° and 240° C.

Figure 6:
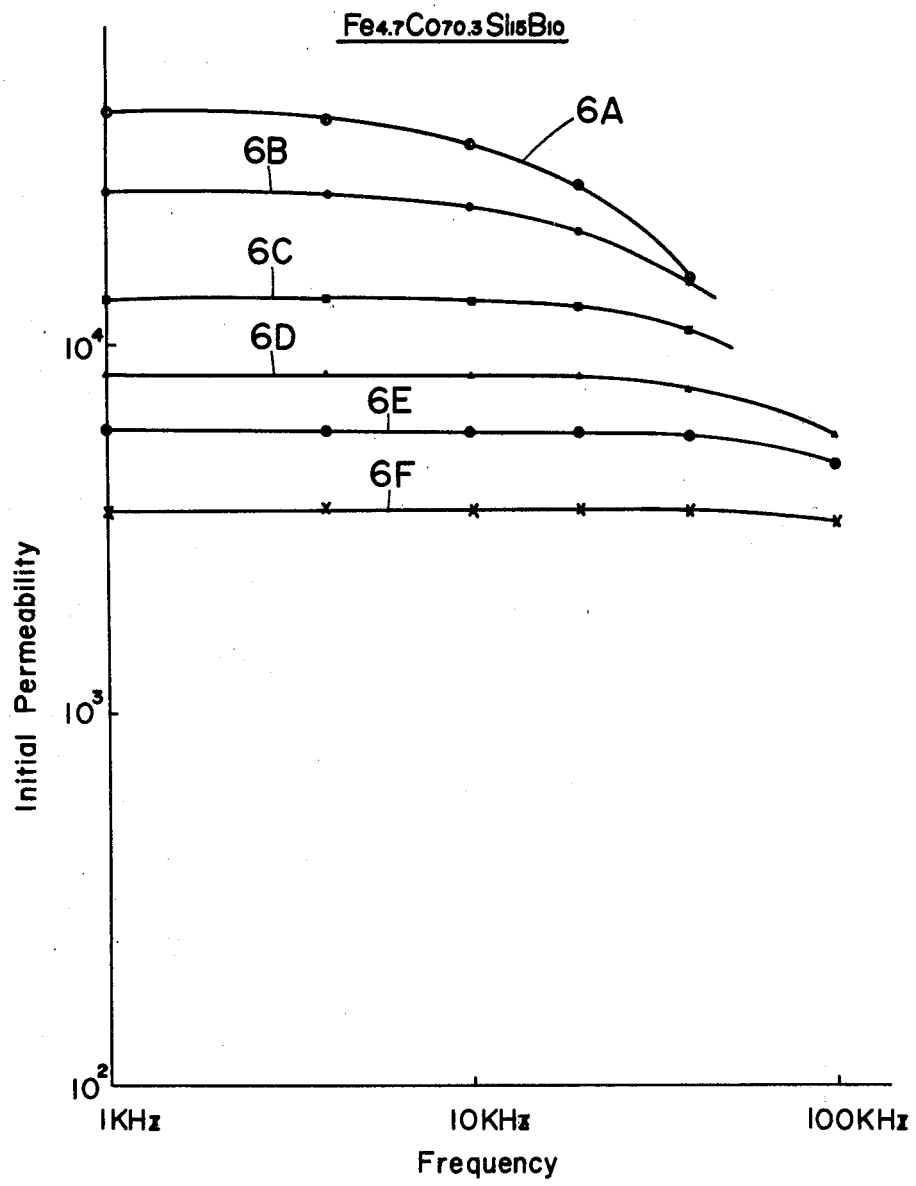

FIG. 6 shows initial permeability versus frequency characteristics of the samples subjected to the heat treatment of the present invention. In FIG. 6, lines 6A to 6F show characteristics of samples each subjected to the same heat treatment as the samples, which characteristics are shown by lines 5A to 5F respectively. It is understood from FIG. 6, that the amorphous magnetic alloy samples subjected to the heat treatment of the present invention are improved in flatness of initial permeability at low frequency as compared with the samples without the heat treatment of the present invention. This flatness in the initial permeability is preferable when the amorphous magnetic alloy is used as a magnetic playback head, while as shown in FIG. 5 the flatness in the permeability ($\mu'_{10}$) is preferable when the alloy is used as a magnetic recording head.

Figure 7:
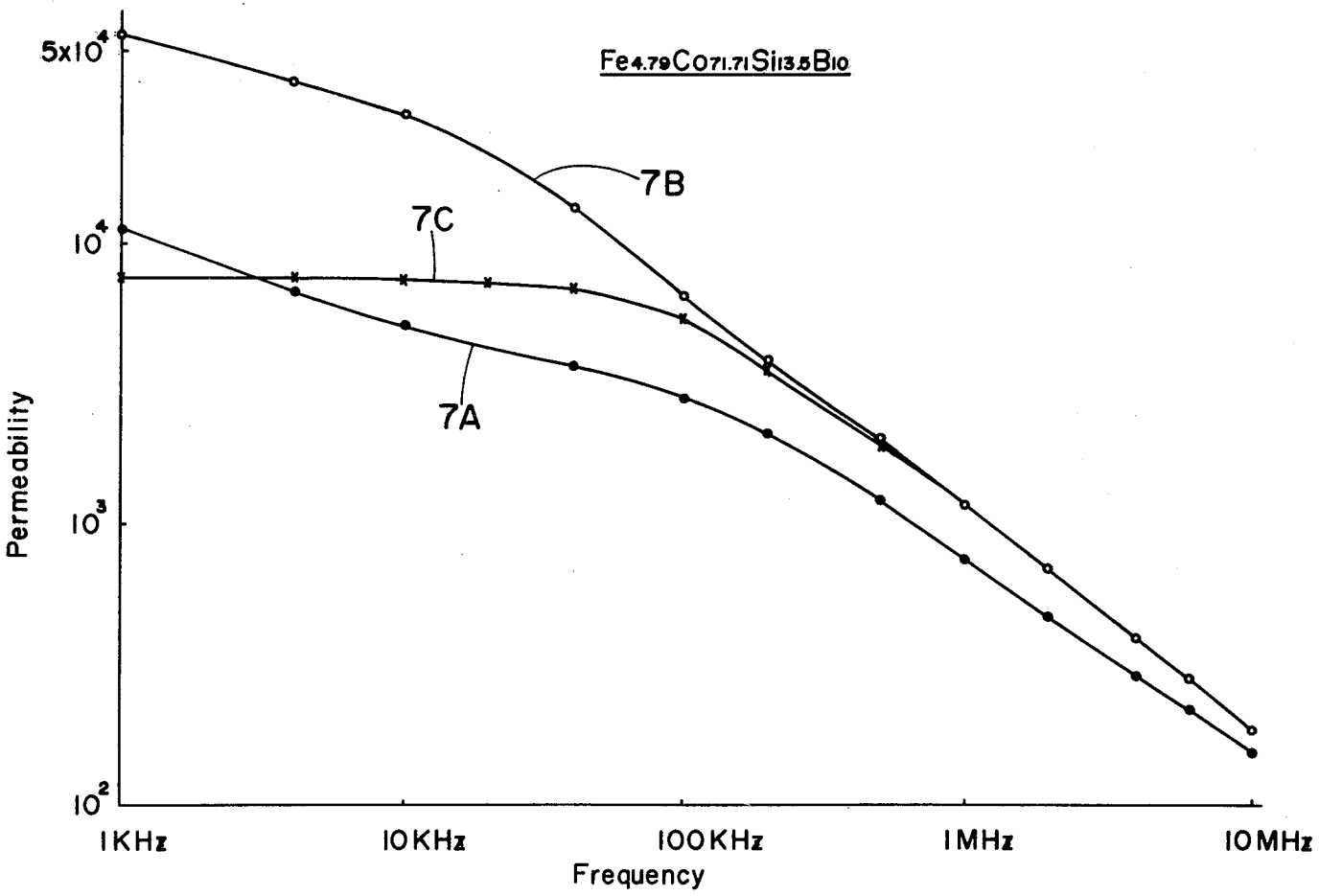

FIG. 7 shows permeability versus frequency characteristics of amorphous alloy samples having a composition of $Fe_{4.79}Co_{71.71}Si_{13.5}B_{10}$ (saturation magnetic induction Bs=9100 gauss). The permeability was measured under a magnetic field of 10mOe as in case of FIG. 5. In FIG. 7, line 7A shows the characteristics of the sample as prepared, line 7B shows the characteristics of the sample subjected to a heat treatment at 450° C. for 3 minutes and then quenched. Line 7C shows the characteristics of the sample subjected to the heat treatment of the present invention, that is, the sample was further heat treated at 200° C. for 20 minutes without applying an external magnetic field subsequent to the heat treatment for line 7B. It is understood from FIG. 7, that the amorphous alloy sample subjected to the heat treatment of the present invention is superior in flatness of permeability and has higher permeability than the sample as prepared.

The present invention was described according to the examples, but it is apparent that many modifications can be effected without departing the sprit of the present inveniton. For example various amorphous magnetic alloys can be treated, and the amorphous alloys can be shaped in any shape as requested. The processing can be ultrasonic cutting, press punching, or chemical etching. It is also apparent that the present invention can be applied to not only cores of the magnetic transducer head but any magnetic core elements.

We claim as our invention:

1. A method of manufacturing a high permeability amorphous magnetic alloy comprising the steps of;

(a) preparing an amorphous magnetic alloy having a Curie temperature Tc(°K.) which is lower than its crystallization temperature Tcry (°K.), said alloy containing between 70 and 78 atomic % of Co, Fe, and Ni, and 22 to 30 atomic % of at least one of the glass forming elements Si, B, P, C, and Ge, (b) keeping said alloy at a first temperature $T_1$ (°K.) satisfying the relation $0.95 > Tc(°K.) \leqq T_1(°K.) < Tcry(°K.)$, (c) quenching said alloy from said first temperature $T_1$ (°K.), and (d) annealing said alloy at a second temperature $T_2$ between 100° and 250° C. in the absence of an applied magnetic field.

2. A method of manufacturing a high permeability amorphous magnetic alloy for use as a core element of a magnetic circuit, comprising the steps of;

(a) preparing an amorphous magnetic alloy having a predetermined shape as said core element, said alloy having a Curie temperature Tc(°K.) which is lower than its crystallization temperature Tcry(°K.), said alloy containing between 70 to 78 atomic % of Co, Fe, and Ni, and 22 to 30 atomic % of at least one of the glass forming elements Si, B, P, C, and Ge, (b) keeping said alloy at a first temperature $T_1$(°K.) satisfying the relation $0.9 \times Tc(°K.) \leqq T_1(°K.) < Tcry(°K.)$, (c) quenching said alloy from said first temperature $T_1$(°K.), and (d) annealing said alloy at a second temperature $T_2$ between 100° and 250° C. in the absence of an applied magnetic field.

3. A method according to claim 1, wherein said alloy in represented by the formula $(fe_{1-x}Co_x)_{100-z}(Si_{1-y}B_y)_z$ where $0.90 \leqq x \leqq 0.98$, $0.30 \leqq y \leqq 0.80$, $22 \leqq z \leqq 30$.

4. A method according to claim 1, wherein said first temperature $T_1$(°K.) satisfies the formula $0.97 > Tc(°K.) \leqq T_1(°K.) \leqq 0.98 \times Tcry(°K.)$.

5. A method according to claim 1, wherein said second temperature $T_2$ is between 180° and 240° C.

6. A method according to claim 1, wherein said quenching is carried out at a cooling rate of not less than 100° C./sec.

7. A method according to claim 6, wherein said quenching is carried out at a cooling rate of not less than 500° C./sec.

* * * * *